United States Patent [19]

Vogels et al.

[11] Patent Number: 4,719,961

[45] Date of Patent: Jan. 19, 1988

[54] VERTICAL OR BOW-TYPE CONTINUOUS CASTING MACHINE FOR STEEL

[75] Inventors: Jochen Vogels, Ratingen; Hans Streubel, Erkrath; Hans O. Thörner, Meerbusch, all of Fed. Rep. of Germany

[73] Assignee: SMS Schloemann-Siemag Aktiengesellschaft, Dusseldorf, Fed. Rep. of Germany

[21] Appl. No.: 892,984

[22] Filed: Aug. 4, 1986

[30] Foreign Application Priority Data

Aug. 9, 1985 [DE] Fed. Rep. of Germany ..... 3528649

[51] Int. Cl.[4] ..... B22D 11/10; B22D 11/04

[52] U.S. Cl. ..... 164/439; 164/443; 164/507; 164/485

[58] Field of Search ..... 164/439, 471, 507, 418, 164/459, 443, 338.1, 485, 468, 487; 222/593

[56] References Cited

U.S. PATENT DOCUMENTS

| | | | |
|---|---|---|---|
| 443,536 | 12/1890 | Norman | 164/419 |
| 2,962,277 | 11/1960 | Morrill | 164/439 |
| 3,073,441 | 1/1963 | Priaroggia et al. | 164/419 |
| 3,189,957 | 6/1965 | Luteijn | 164/439 |
| 3,788,383 | 1/1974 | Metz | 164/439 |
| 3,941,182 | 2/1976 | Bjorksten et al. | 164/419 |
| 4,135,030 | 1/1979 | Basche | 164/24 |

FOREIGN PATENT DOCUMENTS

| | | | |
|---|---|---|---|
| 41987 | 12/1979 | Japan | 164/507 |

*Primary Examiner*—Nicholas P. Godici
*Assistant Examiner*—Samuel M. Heinrich
*Attorney, Agent, or Firm*—Russell & Tucker

[57] ABSTRACT

Continuous casting apparatus is provided having a highly conductive, cooled flow-through mold, a feeder for the mold having an upstream and a downstream section with the downstream section in abutment with the mold, a heater associated with the upstream section for maintaining metal in contact therewith above liquidus temperature, the feeder sections being made of refractory material and dimensioned such that the heat from the upstream section is not bled off so rapidly into the cooling elements of the adjacent mold as to start the strand shell development in the upstream section, but sufficiently to let it start in the downstream secton of the feeder.

2 Claims, 4 Drawing Figures

VERTICAL OR BOW-TYPE CONTINUOUS CASTING MACHINE FOR STEEL

BACKGROUND OF THE INVENTION

The invention relates to a vertical or bow-type continuous casting machine for steel, whereby the steel melt is led from a charging funnel through a heated feeding part of refractory material into a cooled mold.

On a known continuous casting machine of this type a funnel shaped casting vessel is provided with a casting pipe which freely extends up to bath level in the mold. To avoid heat losses electric heating resistances are built into the casting pipe. Above the bath level is an externally sealed space into which is conducted gas for the constant maintenance of bath level and discharged through A counterpressure valve (DE-AS No. 21 18 149).

This continuous casting machine with gas-pressure-regulated bath level is rather expensive. The casting pipe freely extending into the mold requires a minimum width of mold opening so that it is not possible to cast very thin formats. The arrangement of the heating coils in the casting pipe is fairly costly considering its wear and tear and is uneconomical.

There is already known a continuous casting equipment where a casting vessel is downwardly narrowed like a funnel to a casting pipe whose outside wall abuts sealingly at the inside wall of the mold. The melt hereby totally fills out mold and casting pipe. The bath level is in the casting vessel. (Handbook of Continuous Casting, Herrmann 1958, page 158, FIG. 597) Also hereby the diameter of the casting pipe determines the necessary minimum width of the mold opening. Because of the butment of the casting pipe at the mold wall there arise corners in which may occur unfavorable freezing of the melt and thus penetrations of the strand shell.

OBJECTS AND SUMMARY OF THE INVENTION

Object of the invention is to provide a cost-effective vertical or bow-type continuous casting machine for steel on which uncontrolled strand shell development is eliminated so that feeding parts of small through-flow cross-section can be used without the risk of freezing over.

This object is achieved according to the invention in that for the casting of thin slabs under 100 mm thickness and strip the feeding part has a through-flow cross-section corresponding to the casting format and consists of a first section A heatable to liquidus-temperature of the steel and a second uncooled section B aligned with the mold wall and sealingly connected thereto.

On the thus created continuous casting machine the strand shell development is being stopped in the heated first section A of the feeding part. There can be used feeding parts with through-flow widths of to about 5 mm. In the uncooled second section B of the feeding part begins the development of the strand shell. In the section B takes place the heat transmission from the heated first section to the cooled copper mold. Through this is prevented that heat supplied in section A is removed through the copper mold. No control of the bath level is required.

The feeding part consists beneficially of a high temperature-resistant and wear-resistant material such as e.g. zirconium oxide. The feeding part may be formed of plates which are being held by an external support frame.

On very thin through-flow cross-sections the heated section of the feeding part may be enlarged into a feed funnel.

According to another feature of the invention the walls have in the first section an external constriction in which is arranged a heating equipment. The heating equipment may be provided with a resistance heating.

Alternatively there may be arranged around the constriction area of the feed part ledges of electrically conductive, high-temperature resistant material to which is assigned an induction heating.

According to a further alternative there are embedded in section A of the feeding part surrounding ledges of electrically conductive, high-temperature-resistant material which ledges form a part of the through-flow surface and to which is assigned an induction heating.

The inductively heated ledges may beneficially consist of metallic or metalloceramic sinter materials.

To prolong the service life the ledges may be coated with high temperature-resistant, wear-resistant material, e.g. zirconium oxide.

BRIEF DESCRIPTION OF THE DRAWINGS

In the drawing are shown exemplified embodiments of the invention.

DETAILED DESCRIPTION OF PREFERRED EMBODIMENT

Figure 2:
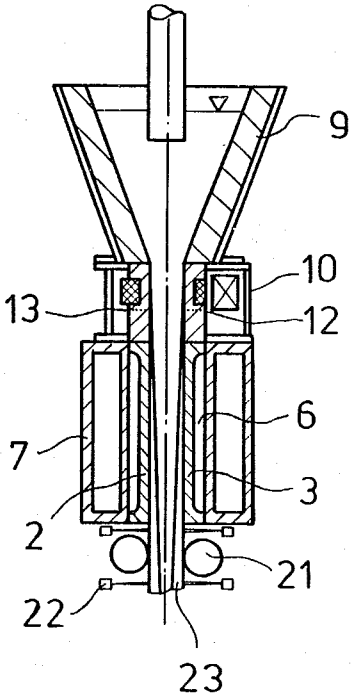
FIGS. 1 and 2 illustrate a continuous casting mold with casting funnel and a feed part in vertical cuts.

According to the drawing a mold 1 for the casting of thin slabs and strip consists of two broad side walls 2, 3 and two narrow side walls 4, 5 which are provided with cooling channels 6. The mold 1 is held in a frame 7 which serve for guidance of the cooling water. The narrow side walls 4, 5 can be adjusted through spindles 8 in order to change the width of the casting format.

Above the mold 1 is a charging funnel 9 which is braced through a support frame 10 on the mold frame 7. Into the charging funnel 9 projects a casting pipe 11 connected with an undepicted casting vessel by means of which the charging funnel 9 is being filled with steel melt.

Between the charging funnel 9 and the mold 1 is situated in each case a feeding part 12, 13 or 14, whose through-flow cross-section corresponds approximately to the casting format. Each one of the feeding parts 12, 13, and 14 consists of a heatable section A which is connected with the charging funnel 9 and a lower section B which is in contact with the top of the mold 1. The feeding parts 12, 13, 14 are preferably formed of plates which are held in the carrier frame 10. As the illustrations show the heatable section A of the feeding parts 12, 13, 14 can be shaped in various manners.

Figure 1:
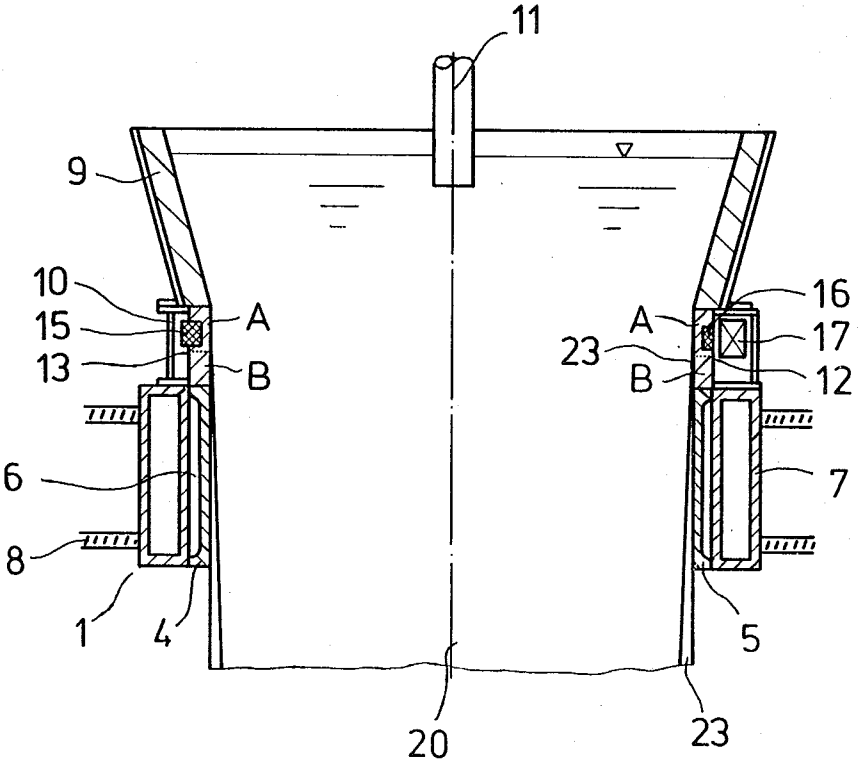

According to FIGS. 1 and 2 the section A of the feeding parts 12, 13 is provided with a constriction in which are arranged an electric resistance heating 15, as shown at the left side, or ledges 16 of electrically conductive, refractory material e.g. metallo-ceramic sinter materials as illustrated on the right side. To the ledges 16 are assigned the coils 17 as induction heating closely spaced.

Figure 4:
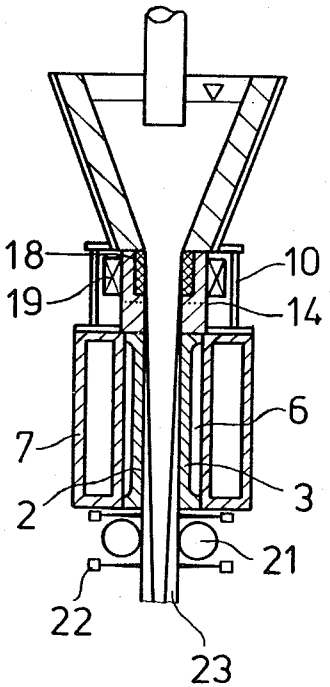
FIGS. 3 and 4 illustrate a continuous casting mold with casting funnel and another feeding part in vertical cuts.
Figure 3:
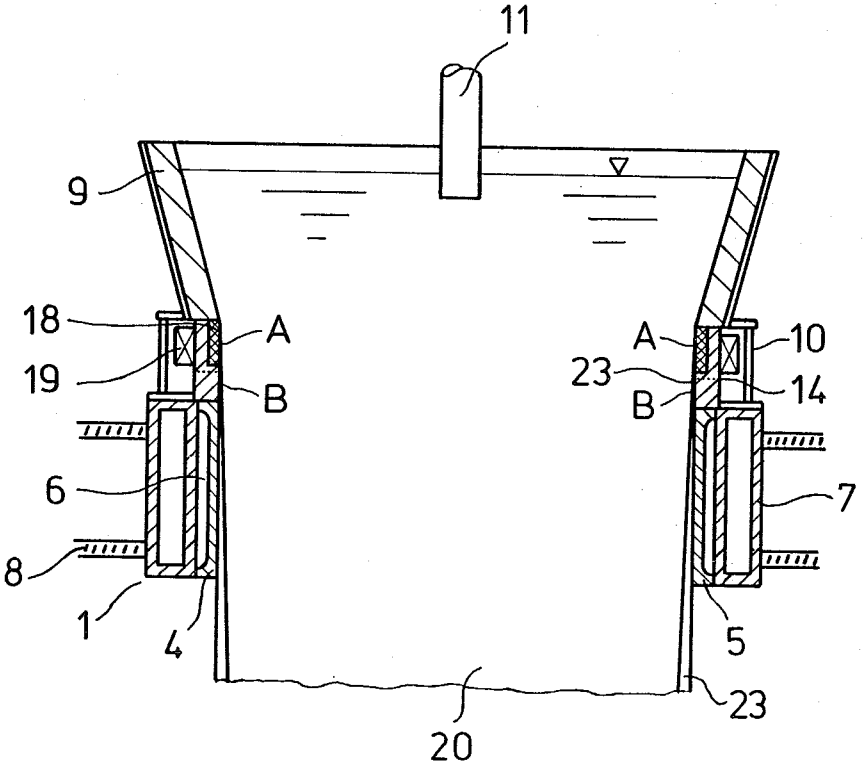

In the alternative execution according to FIGS. 3 and 4 there is provided a feeding part 14 in the first section A with an internal recess in which are inserted ledges 18 of electrically conductive, refractory material. To the ledges 18 are assigned at the outside wall of the feed part 14 induction coils 19 for heating up. To improve the service life the ledges are coated with a high-temperature resistant, wear-resistant material e.g. zirconium oxide.

The steel melt flowing from the charging funnel 9 into the feeding part 12, 13, 14 with the narrow through-flow crosssection corresponding to the casting format strand shell development is being prevented in this section through the heating up of the section A to liquidus temperature. In the unheated and uncooled section B there takes place a heat decrease from the liquidus temperature to the cooled copper mold 1. Therefore there occurs only in section B of the feeding part 12, 13 or 14 the forming of the strand shell 23 and continues continuously within the mold 1. After exiting from the mold 1 the strand 20 is guided in known manner through supporting rollers 21 and cooled through water spray nozzles 22.

What we claim is:

1. Apparatus for the continuous casting of steel comprising:

an elongated continuous casting mold of heat conductive metal having an open inlet end, an open outlet end, and walls forming a substantially parallel sided mold cavity therebetween;

means for cooling said mold;

refractory feeding means having an inlet end and an outlet end for introducing molten metal to the inlet end of said mold, said feeding means having walls forming a substantially parallel sided feeding cavity between its inlet and outlet ends with the planes of the walls of the feeding cavity conforming dimensionally and positionally to the walls of the mold cavity to form a feeding cavity between the walls of the feeding means having a cross section which is substantially the same as that of the mold cavity, said feeding means aligned and in abutment with the inlet end of the mold;

a charging funnel having an a flared inlet end and a constricted outlet end, said outlet end for supplying molten metal to said feeding means and being coterminous therewith;

a casting pipe for pouring molten metal into said charging funnel;

said feeding means comprising an upstream section in abutment with the constricted outlet end of said carging funnel, and a downstream section in abutment with the inlet end of said casting mold;

means associated with the upstream section of said feeding means for maintaining metal in contact therewith and upstream thereof above liquidus temperature; and means associated with the downstream section of said feeding means for cooling said downstream section sufficiently to start the strand shell development of said metal in said downstream section while at the same time preventing the rapid conduction of heat from said upstream section into the cooling means for said mold.

2. The apparatus defined in claim 1, further characterized by:

the walls of both said mold and said feeding means respectively comprising plates, and a frame associated with both said mold and said feeding means for supporting said plates and holding them in place.

* * * * *